United States Patent [19]

Kamon et al.

[11] Patent Number: 4,965,838

[45] Date of Patent: Oct. 23, 1990

[54] EAR PIECE TRANSDUCER

[75] Inventors: Yoshiyuki Kamon, Kanagawa; Makoto Yamagishi, Tokyo, both of Japan

[73] Assignee: Sony Corporation, Tokyo, Japan

[21] Appl. No.: 375,144

[22] Filed: Jun. 30, 1989

[30] Foreign Application Priority Data

Jul. 12, 1988 [JP] Japan ..... 63-092401[U]

[51] Int. Cl.[5] ..... H04R 1/10

[52] U.S. Cl. ..... 381/187; 381/183

[58] Field of Search ..... 381/183, 187, 68.6; 181/129, 130; 128/864, 865, 866, 867, 868

[56] References Cited

U.S. PATENT DOCUMENTS

| | | | |
|---|---|---|---|
| 2,078,385 | 4/1937 | Kato | 181/130 |
| 2,430,229 | 11/1947 | Kelsey | 381/68.6 |
| 4,537,187 | 8/1985 | Scott | 128/684 |
| 4,585,089 | 4/1986 | Topholm | 181/130 |
| 4,668,842 | 5/1987 | Yokoyama et al. | 381/183 |
| 4,736,435 | 5/1988 | Yokoyama et al. | 381/187 |

FOREIGN PATENT DOCUMENTS

| | | |
|---|---|---|
| 1179692 | 1/1970 | United Kingdom . |
| 1543333 | 4/1979 | United Kingdom . |

*Primary Examiner*—Jin F. Ng
*Assistant Examiner*—M. Nelson McGeary, III
*Attorney, Agent, or Firm*—Philip M. Shaw, Jr.

[57] ABSTRACT

An ear piece transducer having a housing incorporating therein an electroacoustic transducer element, the housing being inserted into a concave portion of an auricle, and a ring member having resiliency sufficient to enable it to be attached to the outer peripheral portion of the housing, the ring member being formed so as to be thickest in one radial direction.

16 Claims, 3 Drawing Sheets

EAR PIECE TRANSDUCER

BACKGROUND OF THE INVENTION

1. Field of the Invention

The present invention relates generally to electroacoustic transducers and more particularly to an electroacoustic transducer such as an earphone or the like which is worn over or inserted into an auditory opening.

2. Description of the Prior Art

U.S. Pat. No. 4,736,435 discloses a so-called inner-ear type earphone which is inserted into an auditory opening. FIG. 1 shows an example of such an inner-ear type earphone.

Referring to FIG. 1, it will be seen that a driver unit 15 is accommodated within a housing 16. The driver unit 15 is an electroacoustic transducer element and is formed of a diaphragm, a magnetic circuit or the like, though not shown. An external connection cord 17 is extended from the driver unit 15 and is supported by a cord supporting member 18. The cord supporting member 18 is elongated from the housing 16.

As shown in FIG. 2, the housing 16 is made by molding a synthetic resin and is formed in such a size that it can be inserted into a cavum concha b which is a concave portion of an auricle a. When the housing 16 is inserted into the cavum concha b, at least two points of the outer peripheral surface of the housing 16 are supported by a tragus c and an antitragus d which form a part of the auricle a.

The rear peripheral portion of the housing 16, which is opposed to the outside of the auricle a when the housing 16 is inserted into the cavum concha b, is formed as a tapered, inclined portion 19. The inclination angle of the inclined portion 19 is selected so that the inclined portion 19 substantially corresponds to the curved, rising surface of the cavum concha b.

The cord supporting member 18 extended from the housing 16 is downwardly elongated from the lower end of a rear side edge wall 20 of the housing 16 and is substantially parallel to the rear side edge wall 20. When the housing 16 is inserted into the cavum concha b, the cord supporting member 18 comes in contact with a point P3 on the outer surface of a lobe e at the position lower than points P1 and P2 of the tops of the tragus c and the antitragus d. The points P1 and P2 are the supporting points to support the housing 16.

A ring 21 is made of flexible and resilient material and is engaged with a connection portion in which the driver unit 15 and the housing 16 are connected. Referring back to FIG. 1, it will be seen that a protecting plate 22 is located at the front wall of the diaphragm of the driver unit 15. The protecting plate 22 is made of a material such as a metal net or the like having high sound transmission coefficient.

According to the inner-ear type earphone thus made, as shown in FIG. 1, the housing 16 is inserted into the cavum concha b in a three-point supporting fashion so that it can be positively held at one portion of the auricle a without pressing the auditory opening.

In order that any user may wear the inner-ear type earphone shown in the example of FIG. 1 regardless of the size of the ear, in particular, the size of the cavum concha b, this earphone is made in size so as to be inserted into the smallest ear of man.

Accordingly, the thus made earphone is too small for the cavum concha of the larger ear. Thus, when the earphone is inserted into the auditory opening of a large ear, its closed property is poor and the low band sound is lowered and hence a good acoustic characteristic is not expected.

OBJECTS AND SUMMARY OF THE INVENTION

It is an object of the present invention to provide an improved electroacoustic transducer which can remove the above-mentioned defects encountered with the prior-art electroacoustic transducer.

It is another object of the present invention to provide an electroacoustic transducer which is excellent in a closed property.

It is still another object of the present invention to provide an electroacoustic transducer which can prevent the acoustic characteristic in the low band from being deteriorated.

It is still another object of the present invention to provide an electroacoustic transducer which can provide a good acoustic characteristic.

According to an aspect of the present invention, there is provided an electroacoustic transducer comprising:

(a) a housing incorporating therein an electroacoustic transducer element, said housing being formed such that it is inserted into a concave portion of an auricle; and (b) a ring member having resiliency sufficient so that it is attached to the outer peripheral portion of said housing, and said ring member is formed so as to increase its thickness in one direction from a center of housing body.

These and other objects, features and advantages of the present invention will be apparent in the following detailed description of preferred embodiments of the invention when read in conjunction with the accompanying drawings, in which like reference numerals identify the same or similar parts in the several views.

DETAILED DESCRIPTION OF PREFERRED EMBODIMENTS

Figure 1:
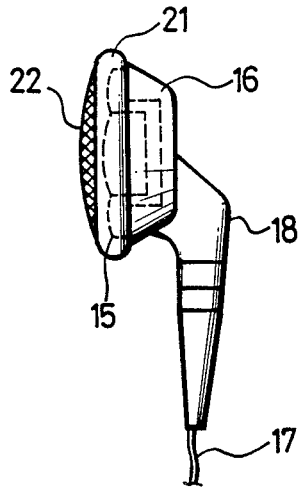
FIG. 1 (PRIOR ART)
FIG. 1 is a cross-sectional side view of an example of a prior-art earphone.
Figure 2:
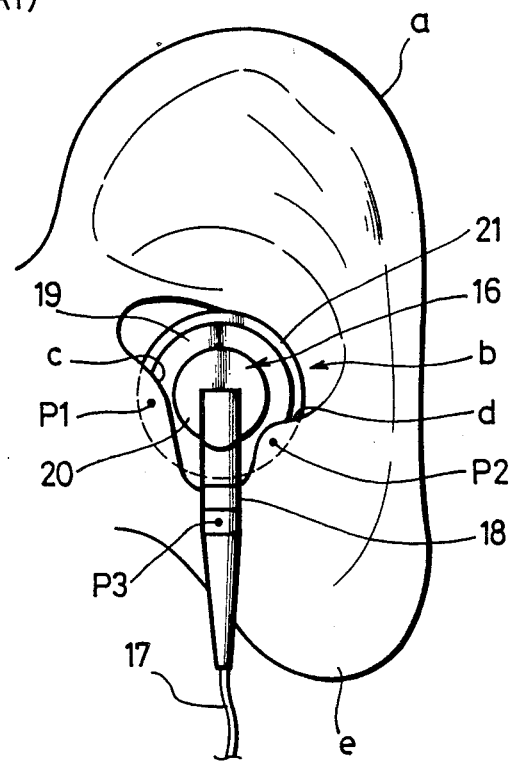
FIG. 2 (PRIOR ART)
FIG. 2 is a pictorial representation of the condition that the earphone shown in FIG. 1 is inserted into a cavum concha upon use.
Figure 3:
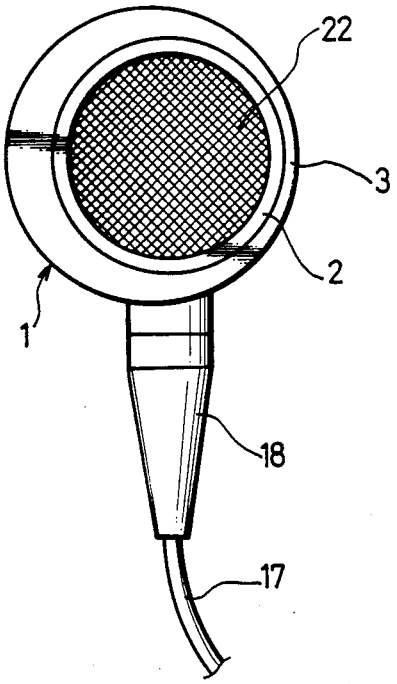
FIG. 3 is a plan view of an embodiment of an earphone according to the present invention.
Figure 4:
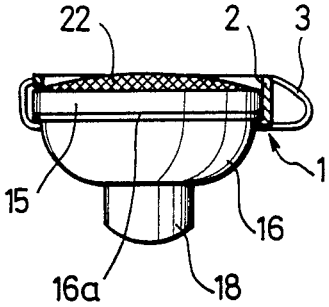
FIG. 4 is a partly cut-away, rear view of the earphone shown in FIG. 3.

An embodiment of an electroacoustic transducer such as an earphone according to the present invention will now be described with reference to FIGS. 3 and 4. In FIGS. 3 and 4, like parts corresponding to those of FIGS. 1 and 2 are marked with the same references and therefore need not be described in detail.

Referring to FIGS. 3 and 4, it will be seen that an annular ring member 1 (referred to hereafter as ring member 1) having resiliency is engaged with a connection portion where the housing 16 and the driver unit 15 are connected.

Figure 5:
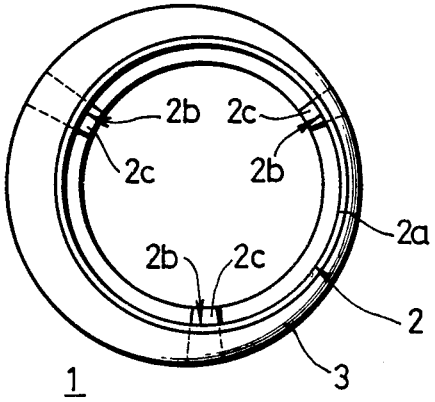
FIG. 5 is a plan view of a ring member used in the earphone of the invention shown in FIG. 3.
Figure 6:
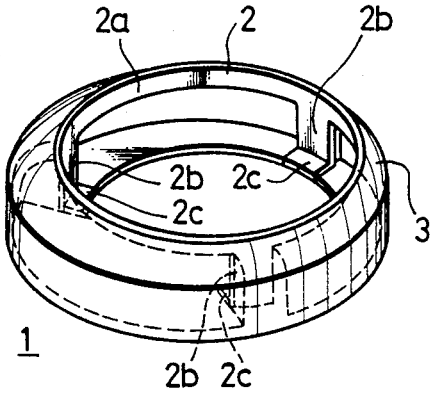
FIG. 6 is a perspective view of the ring member shown in FIG. 5.

The ring member 1 is formed such that as shown in FIGS. 5 and 6 the centers of the inner and outer circles thereof are displaced from each other. In other words, since the ring member 1 opposite the area between the two circles, it is formed to increase in annular width from a narrowest portion on the side where the circumferences of the circles are the closest to a widest portion in one direction from the center of the housing. This ring member 1 is formed of a base ring portion 2 on an inner peripheral side and a resilient ring portion 3 on an outer peripheral side which are molded by the resin molding process such as a so-called two color molding process or dichromatic molding manner.

The base ring portion 2 is formed by molding a resin material having a sufficient hardness, for example, polycarbonate. The base ring portion 2 is comprised of a ring-shaped base portion 2*a* and three leg portions 2*b* each being extended therefrom and having a protrusion 2*c* at its tip end. The resilient ring portion 3 is made by molding a material rich in resiliency such as silicon or the like. The resilient ring portion 3 is made hollow except its portions corresponding to the leg portions 2*b* of the base ring portion 2.

When the ring member 1 constructed as described above is engaged with the connection portion between the housing 16 and the driver unit 15, the base portion 2*a* of the base ring portion 2 is faced to the protecting plate 22 side. In this case, the base portion 2*a* is engaged with the protecting plate 22 and the protrusions 2*c* are engaged with a flange portion 16*a* of the housing 16. The ring member 1 is arranged with its portion of greatest annular width located in the direction of the antitragus d side. FIGS. 3 and 4 illustrate the earphone which is inserted into the auditory opening of the left-hand side ear. If the earphone of the invention is formed as an earphone for a right-hand side ear, then the ring member 1 is arranged with its portion of greatest annular width located in the reverse direction, though not shown.

Figure 7:
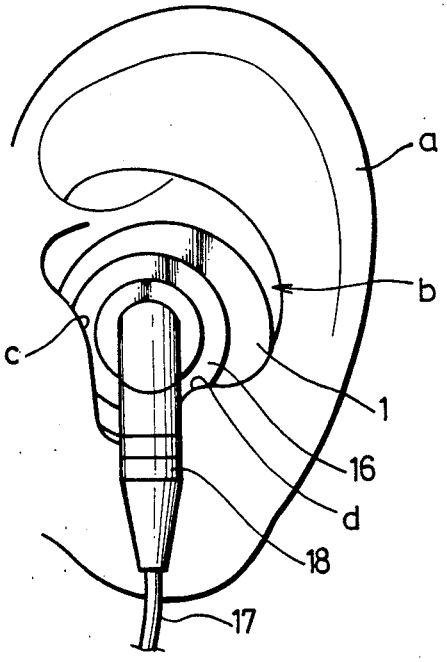
FIG. 7 is a pictorial representation of the condition that the earphone shown in FIG. 3 is inserted into the cavum concha upon use.

Upon use, the earphone thus made is inserted into the cavum concha b as shown in FIG. 7. The auricle opening is not located at the center of the cavum concha b and is displaced to the tragus c side. Therefore, the increased annular width of the resilient ring member 1 is selected so that when the earphone is inserted into the cavum concha b, the diaphragm of the driver unit 15 is opposed to the auditory opening.

According to this embodiment, the resilient ring member 1 is arranged with its portion of greatest annular width located toward the antitragus d side so that when the user wears the earphone, the resilient ring portion 3 of the ring member 1 is resiliently deformed so as to be fitted to the shape of the cavum concha b. Thus, the resilient ring portion 3 is resiliently deformed in accordance with the shape of the cavum concha b, resulting in the closed property being increased. Consequently, the low band portion of the frequency band of the acoustic characteristic can be suppressed from being lowered and hence, an excellent acoustic characteristic can be obtained.

Figure 8:
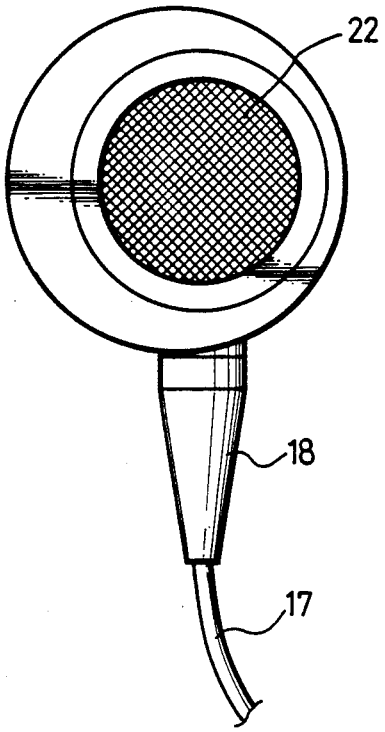
FIG. 8 is a plan view of another embodiment of an earphone according to the present invention.
Figure 9:
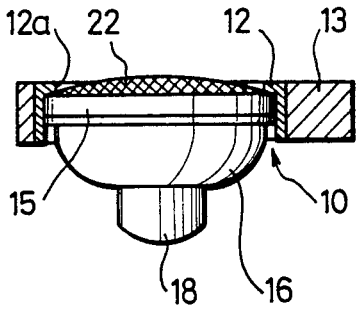
FIG. 9 is a partly cut-away, rear view of the earphone shown in FIG. 8.

Another embodiment of an earphone according to the present invention will be described hereinafter with reference to FIGS. 8 and 9. In FIGS. 8 and 9, like parts corresponding to those of FIG. 1 are marked with the same references and therefore need not be described in detail.

Referring to FIGS. 8 and 9, it will be seen that a resilient ring member 10 is engaged with the connection portion where the housing 16 and the driver unit 15 are connected.

Figure 10:
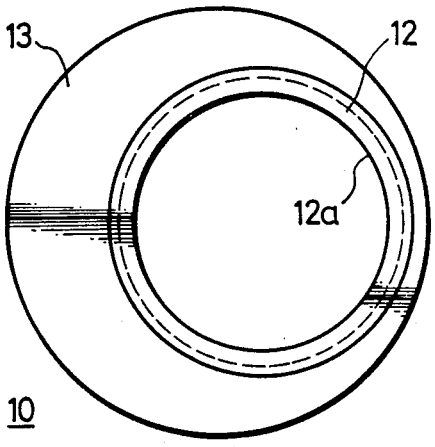
FIG. 10 is a plan view of a ring member used in the earphone shown in FIG. 8.
Figure 11:
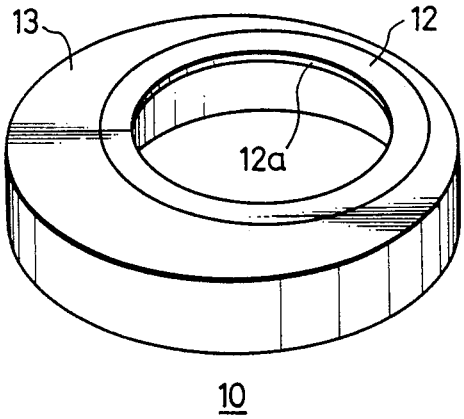
FIG. 11 is a perspective view of the ring member shown in FIG. 10.

As shown in FIGS. 10 and 11, the resilient ring member 10 is formed such that the centers of the inner circle and the outer circle are displaced from each other such that again the annular width of the ring member 10 varies from a narrowest portion on the side where the circumferences of the circles are the closest to a widest portion in the direction from the center of the housing in which the circumferences are farthest apart. The ring member 10 is formed of a base ring portion 12 at the inner peripheral side and a resilient ring portion 13 of the outer peripheral side according to the resin molding process, for example, the dichromatic molding process.

The base ring portion 12 is formed by molding a material having a sufficient hardness, for example, acrylonitrile butadiene styrene copolymer (ABS) resin. The base ring portion 12 is formed as a cylindrical shape having a circular edge portion 12*a*. The resilient ring portion 13 is formed by molding a material rich in resiliency such as urethane or the like.

The above-mentioned ring member 10 is engaged with the connection portion between the housing 16 and the driver unit 15 in such a manner that the circular edge portion 12*a* of the base ring portion 12 is faced to the side of the protecting plate 22. In this case, the edge portion 12 is engaged to the protecting plate 22. The ring member 10 is arranged such that its portion of greatest annular width is positioned toward the antitragus d. FIGS. 8 and 9 show the earphone which is inserted into the cavum concha of the left-hand side ear. The earphone, which is suitably inserted into the cavum concha of the right-hand side ear, though not shown, is so arranged that the portion of greatest of the ring member 10 is positioned in the reverse direction to that shown in FIG. 8.

Upon use, the earphone according to the second embodiment of the present invention is inserted into the cavum concha b similarly to the first embodiment shown in FIG. 7. In this embodiment, the increased portion of greatest annular width of the ring member 10 is selected similarly to the first embodiment.

According to this embodiment, the resilient ring member 10 is arranged with its portion of greatest annular width located toward the antitragus d side so that when the user wears the earphone, the resilient ring portion 13 of the ring member 10 is resiliently deformed and the ring member 10 is properly fitted into the cavum concha b. Thus, the closed property of the earphone can be increased and similar action and effect to those of the above-mentioned first embodiment can be achieved.

While both the ring members 1 and 10 are formed such that the centers of the inner circle and the outer circle are displaced from each other as described above, the outer form of the ring members is not limited to the circle but it may be an ellipse and other forms. In short, the ring member 10 has its portion of greatest annular width located in one direction from the center of the housing 16.

According to the present invention, as described above, since the resilient ring member is arranged to increase its thickness in one direction from the center of the housing and this ring member is attached to the outer peripheral portion of the housing, upon use, the resilient ring portion of the ring member is resiliently deformed and can be properly fitted into the cavum concha. Thus, the closed property can be increased, and the acoustic characteristic can be suppressed from being lowered at the low frequency band portion. Therefore, it is possible to obtain excellent acoustic characteristic.

It should be understood that the above description is presented by way of example on the preferred embodiments of the invention and it will be apparent that many modifications and variations thereof could be effected by one with ordinary skill in the art without departing from the spirit and scope of the novel concepts of the invention so that the scope of the invention should be determined only by the appended claims.

We claim as our invention:

1. An ear piece transducer comprising:

(a) a housing incorporating therein an electroacoustic transducer element, said housing being formed such that it is inserted into a concave portion of an auricle; and (b) an annular ring member attached to the outer peripheral portion of said housing, said annular ring member being formed of varying annular width thickness such that it is widest in one radial direction from the center of said housing, whereby at least a portion of said annular ring member is made of a resilient material.

2. An ear piece transducer according to claim 1, in which said annular ring member is attached to said housing so that when said electroacoustic transducer is inserted into said concave portion of the auricle, the widest portion of said annular ring member is positioned toward the antitragus side of said auricle.

3. An ear piece transducer according to claim 1, in which said annular ring member is formed such that when said electroacoustic transducer is inserted into said concave portion of the auricle, a diaphragm of said electroacoustic transducer element is located directly facing the auditory canal opening.

4. An ear piece transducer according to claim 1, in which said annular ring member is formed of a base ring portion and a resilient ring portion made of a material more resilient than that forming said base ring portion.

5. An ear piece transducer according to claim 4, in which said base ring portion is provided with a plurality of leg portions each having a protrusion engageable with a flange portion of said housing and said resilient ring portion is made hollow except for portions corresponding to said leg portions.

6. An ear piece transducer according to claim 4, in which said base ring portion is provided with an edge portion which is engaged with a sound emanating surface side of said electroacoustic transducer element incorporated within said housing.

7. An ear piece transducer according to claim 6, in which said resilient ring portion is made of urethane resin.

8. An ear piece transducer according to claim 4, in which said annular ring member is formed of said base ring portion and said resilient ring portion by means of a resin molding process.

9. An ear piece transducer for use in a human auricle having tragus and antitragus side, comprising:

(a) a housing incorporating therein an electroacoustic transducer element, said housing being formed such that it is inserted into a concave portion of an auricle and having a back surface shaped so that upon such insertion at least two points of said back surface are supported by said tragus and antitragus sides of said auricle respectively;

(b) a protecting plate mounted on said housing on the side of said housing which faces said concave portion of said auricle; and (c) an annular ring member attached to the outer peripheral portion of said housing being formed of varying annular width thickness such that it is widest in one radial direction from the center of said housing, whereby at least a portion of said annular ring member is made of a resilient material.

10. An ear piece transducer according to claim 9, in which said annular ring member is attached to said housing so that when said electro-acoustic transducer is inserted into said concave portion of the auricle, the widest portion of said annular ring member is positioned toward the antitragus side of said auricle.

11. An ear piece transducer according to claim 9, in which said annular ring member is formed such that when said electroacoustic transducer is inserted into said concave portion of the auricle, a diaphragm of said electroacoustic transducer element is located directly facing the auditory canal opening.

12. An ear piece transducer according to claim 9, in which said annular ring member is formed of a base ring portion and a resilient ring portion made of a material more resilient than that forming said base ring portion.

13. An ear piece transducer according to claim 12, in which said base ring portion is provided with a plurality of leg portions each having a protrusion engageable with a flange portion of said housing and said resilient ring portion is made hollow except for portions corresponding to said leg portions.

14. An ear piece transducer according to claim 12, in which said base ring portion is provided with an edge portion which is engaged with a sound emanating surface side of said electroacoustic transducer element incorporated within said housing.

15. An ear piece transducer according to claim 14, in which said resilient ring portion is made of urethane resin.

16. An ear piece transducer according to claim 12, in which said annular ring member is formed of said base ring portion and said resilient ring portion by means of a resin molding process.

* * * * *